US007810744B2

(12) United States Patent
Schmon et al.

(10) Patent No.: US 7,810,744 B2
(45) Date of Patent: Oct. 12, 2010

(54) FLUID RESERVOIR FOR A PAINT SPRAY GUN

(75) Inventors: Ewald Schmon, Grafenberg (DE); Peter Dettlaff, Remseck (DE); Ralf Gehrung, Stuttgart (DE)

(73) Assignee: Sata GmbH & Co. KG, Kornwestheim (DE)

( * ) Notice: Subject to any disclaimer, the term of this patent is extended or adjusted under 35 U.S.C. 154(b) by 359 days.

(21) Appl. No.: 10/597,780

(22) PCT Filed: Apr. 6, 2004

(86) PCT No.: PCT/EP2004/003677

§ 371 (c)(1),
(2), (4) Date: Jan. 10, 2007

(87) PCT Pub. No.: WO2005/077543

PCT Pub. Date: Aug. 25, 2005

(65) Prior Publication Data

US 2007/0158349 A1 Jul. 12, 2007

(30) Foreign Application Priority Data

Feb. 16, 2004 (DE) ..... 10 2004 007 733

(51) Int. Cl.

| | |
|---|---|
| ***B05B 9/04*** | (2006.01) |
| ***B05B 9/047*** | (2006.01) |
| ***B05B 11/02*** | (2006.01) |
| ***B05B 9/00*** | (2006.01) |
| ***B65D 35/56*** | (2006.01) |

(52) U.S. Cl. ..... 239/321; 239/379; 239/320; 239/302; 239/316; 222/105; 222/183

(58) Field of Classification Search ..... 239/302, 239/308, 409, 414, 527, 321, 320, 379, 316; 222/105, 183, 160, 566, 498, 499, 502–544, 222/546–564; 220/360, 345.4, 345.1, 287
See application file for complete search history.

(56) References Cited

U.S. PATENT DOCUMENTS 2,721,004 A * 10/1955 Schultz ..... 222/92

(Continued)

FOREIGN PATENT DOCUMENTS

DE 34 02 097 A1 8/1985

(Continued)

OTHER PUBLICATIONS

International Search Report PCT/EP2004/003677.

(Continued)

*Primary Examiner*—Len Tran
*Assistant Examiner*—Justin Jonaitis
(74) *Attorney, Agent, or Firm*—Martin Fleit; Paul D. Bianco; Fleit Gibbons Gutman Bongini & Bianco PL

(57) ABSTRACT

The invention relates to a fluid reservoir for a paint spray gun, comprising a receptacle (1) and a lid that can be placed thereupon and is provided with a connecting element (3) in order to mount the fluid reservoir on the paint spray gun or an adapter. The receptacle (1) is provided with a ventilation hole (4) which can be sealed using a valve. In order to improve the tightness of the valve, said valve encompasses two valve seats for sealing the ventilation port (4), which are disposed one behind another in the direction of flow.

8 Claims, 7 Drawing Sheets

U.S. PATENT DOCUMENTS

| | | | | |
|---|---|---|---|---|
| 3,090,530 | A | 5/1963 | Peeps | |
| 3,524,589 | A * | 8/1970 | Pelton, Jr. | 239/308 |
| 3,714,967 | A | 2/1973 | Zupan et al. | |
| 4,730,753 | A | 3/1988 | Grime | |
| 5,582,350 | A | 12/1996 | Kosmyna | |
| 5,588,562 | A * | 12/1996 | Sander et al. | 222/153.06 |
| 6,039,218 | A * | 3/2000 | Beck | 222/153.06 |
| 6,540,114 | B1 * | 4/2003 | Popovich et al. | 222/153.02 |
| 6,820,824 | B1 | 11/2004 | Joseph | |
| 6,874,664 | B1 * | 4/2005 | Montgomery | 222/525 |
| 7,416,140 | B2 * | 8/2008 | Camilleri et al. | 239/321 |
| 2003/0209568 | A1 * | 11/2003 | Douglas et al. | 222/321.9 |
| 2004/0129738 | A1 * | 7/2004 | Stukas | 222/420 |
| 2004/0217201 | A1 | 11/2004 | Ruda | |
| 2006/0113409 | A1 * | 6/2006 | Camilleri et al. | 239/600 |

FOREIGN PATENT DOCUMENTS

| | | |
|---|---|---|
| DE | 35 17 122 | 5/1986 |
| DE | 87 02 559.0 | 10/1987 |
| EP | 0 678 334 A2 | 10/1995 |
| GB | 2 132 916 | 7/1984 |
| WO | WO 98/32539 | 7/1998 |
| WO | WO 03/045575 | 6/2003 |

OTHER PUBLICATIONS

International Preliminary Report on Patentability PCT/EP2004/003677.

* cited by examiner

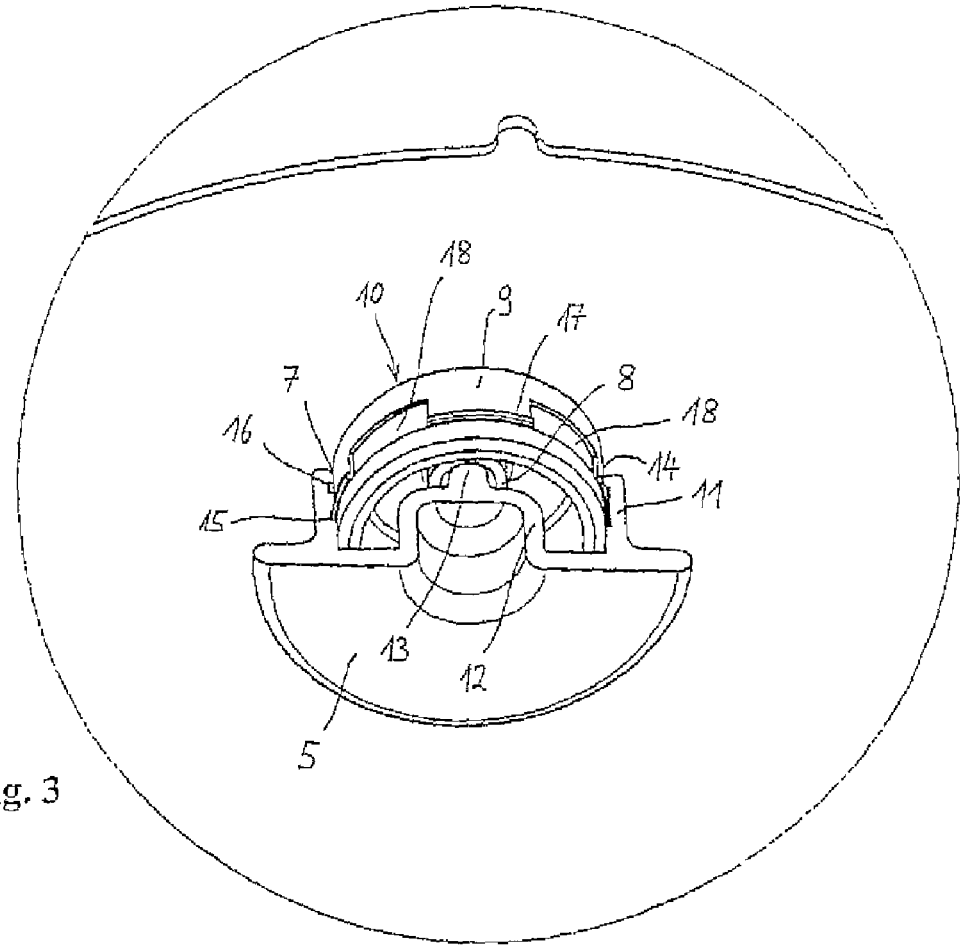
Fig. 3
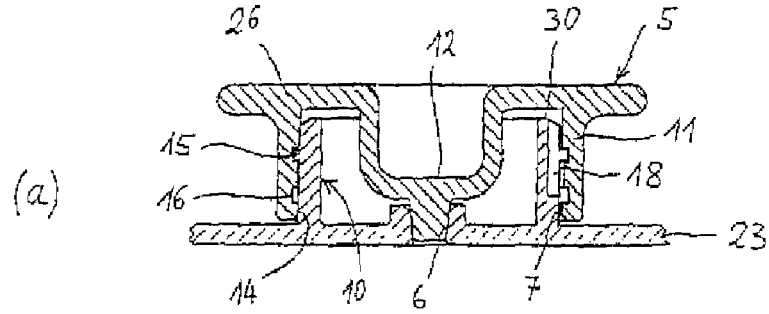
(a)
Fig. 4
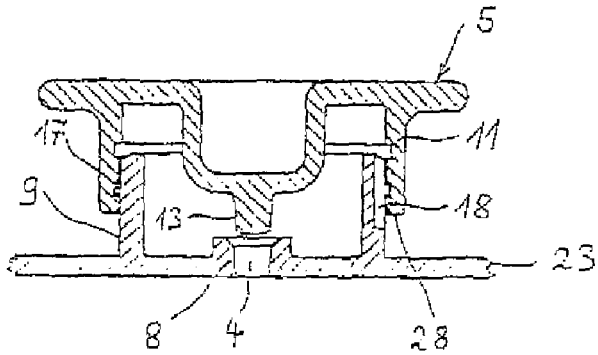
(b)

FLUID RESERVOIR FOR A PAINT SPRAY GUN

FIELD OF THE INVENTION

The invention relates to a fluid reservoir for a paint spray gun.

BACKGROUND OF THE INVENTION

Such a fluid reservoir is known from prior art, for instance, WO 98/32539. This fluid reservoir is provided for one time use and comprises a container of plastic and a lid that can be placed thereon to close off the container. On the lid, connecting means are provided for placing the fluid reservoir on and fastening it to a paint spray gun or an adapter mounted thereon. In this case, the fluid reservoir is placed "upside down" on the paint spray gun, i.e., with lid side down. The paint present in the fluid reservoir then flows by gravity downwards into the paint inlet channel of the paint spray gun. In order to allow the gravity driven flow of paint, it is necessary for the pressure in the interior and that in the environment to be equalized. In order to guarantee this equalization, a ventilation part that can be closed by means of an adhesive tape or a manually operable valve is made in the container's bottom.

All the devices from prior art for closing the ventilation part have proved inadequate with regard to their tightness. Even with a valve mechanism, it cannot be reliably assured that paint will not escape through the ventilation part when the paint filled fluid reservoir is set down on its base.

Starting from this point, the invention is based on the problem of refining the fluid reservoir as known from prior art such that a flow of paint through the ventilation part is reliably prevented.

SUMMARY OF THE INVENTION

This problem is solved by fluid reservoir with the characteristics of Claim 1. Advantageous refinements of this fluid reservoir can be deduced from the subordinate claims.

BRIEF DESCRIPTION OF THE DRAWINGS

The invention will be explained in detail below on the basis of one embodiment with reference to the appended drawing. The drawings show:

FIG. 3, detail view of area Y from FIG. 2;

FIG. 4, sectional representation of a valve for closing the ventilation part in the receptacle bottom of the fluid reservoir from FIG. 2, wherein the valve is shown in the closed position in FIG. 4(*a*) and in the opened position in FIG. 4(*b*);

DETAILED DESCRIPTION OF THE INVENTION

Figure 1:
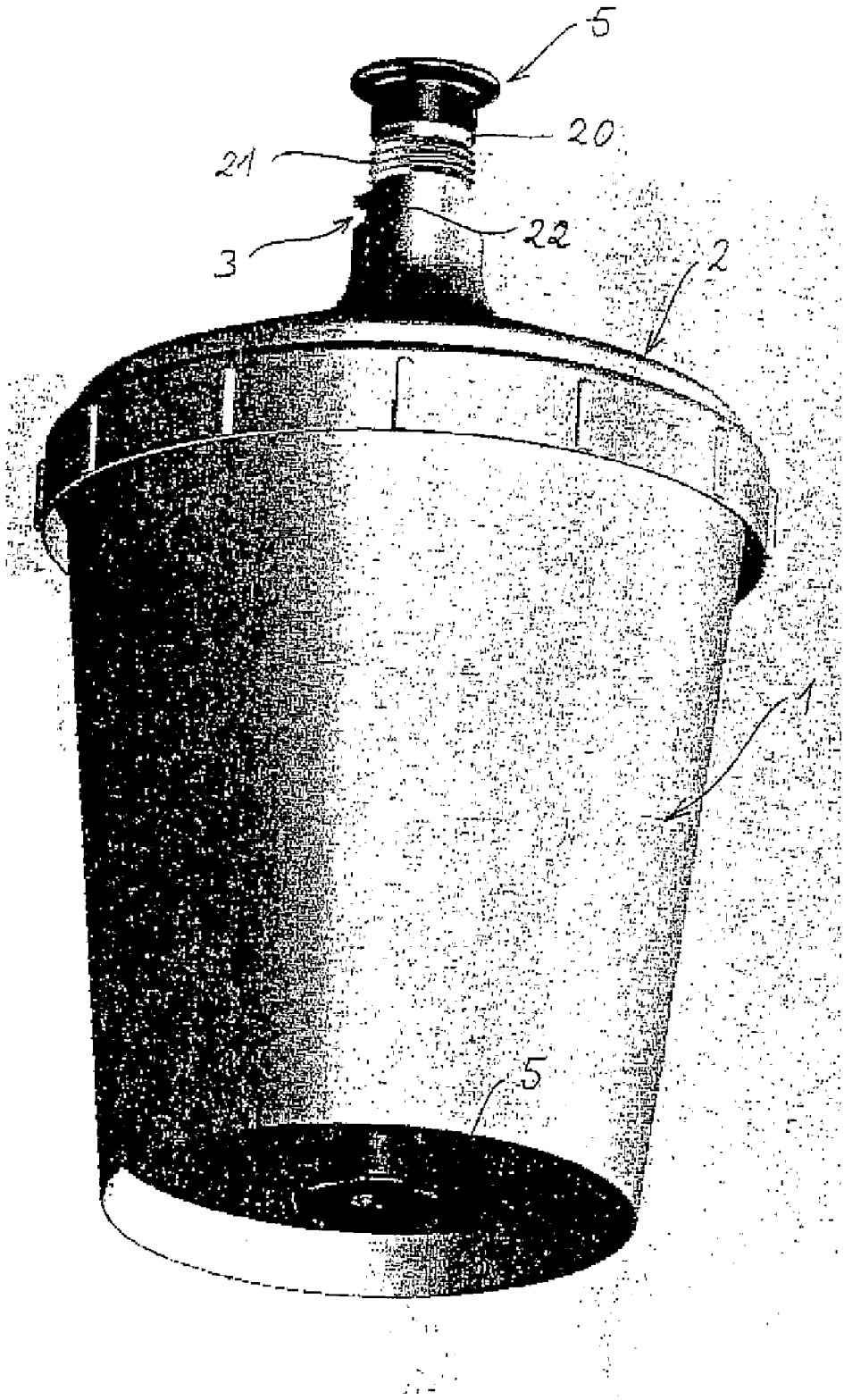
FIG. 1, oblique side view of a fluid reservoir according to the invention.

As shown in FIG. 1, the fluid reservoir according to the invention comprises a cup shaped receptacle 1 and a lid 2 that can be screwed onto it by way of a thread 19. Thread 19 formed on the upper rim of receptacle 1 for screwing lid 2 on is recognizable in FIG. 2. On its upper side, lid 2 has an outlet neck 20 with an outlet opening 20*a*, not shown in FIG. 1. A connecting element 3 is formed on the outer side of outlet neck 20. Connecting element 3 serves for placing and fastening the fluid reservoir on a paint spray gun or on an adapter arranged between the paint spray gun and the fluid reservoir. In the embodiment shown in the figures, connecting element 3 comprises a thread 21 and a wedge shaped groove 22 that cooperate with corresponding connecting elements of the paint spray gun, namely a matching inside thread and a pin for engagement in groove 22.

Figure 2:
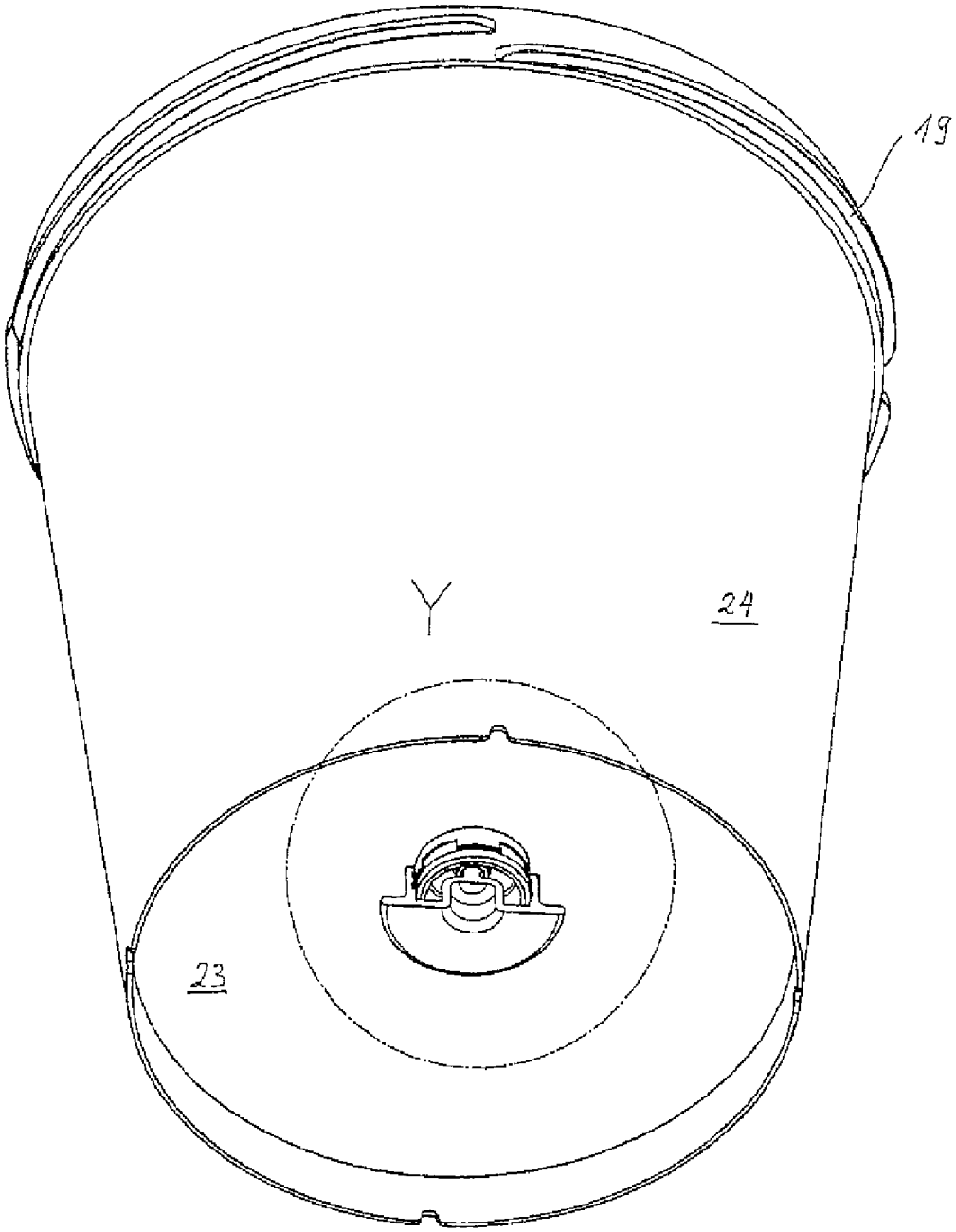
FIG. 2, oblique representation of the container of the fluid reservoir according to the invention from FIG. 1, in a view from obliquely below.

Receptacle 1 is cup shaped with a circular receptacle bottom 23 and sidewall 24 opening upward slightly conically, as is evident from FIG. 2.

Figure 5:
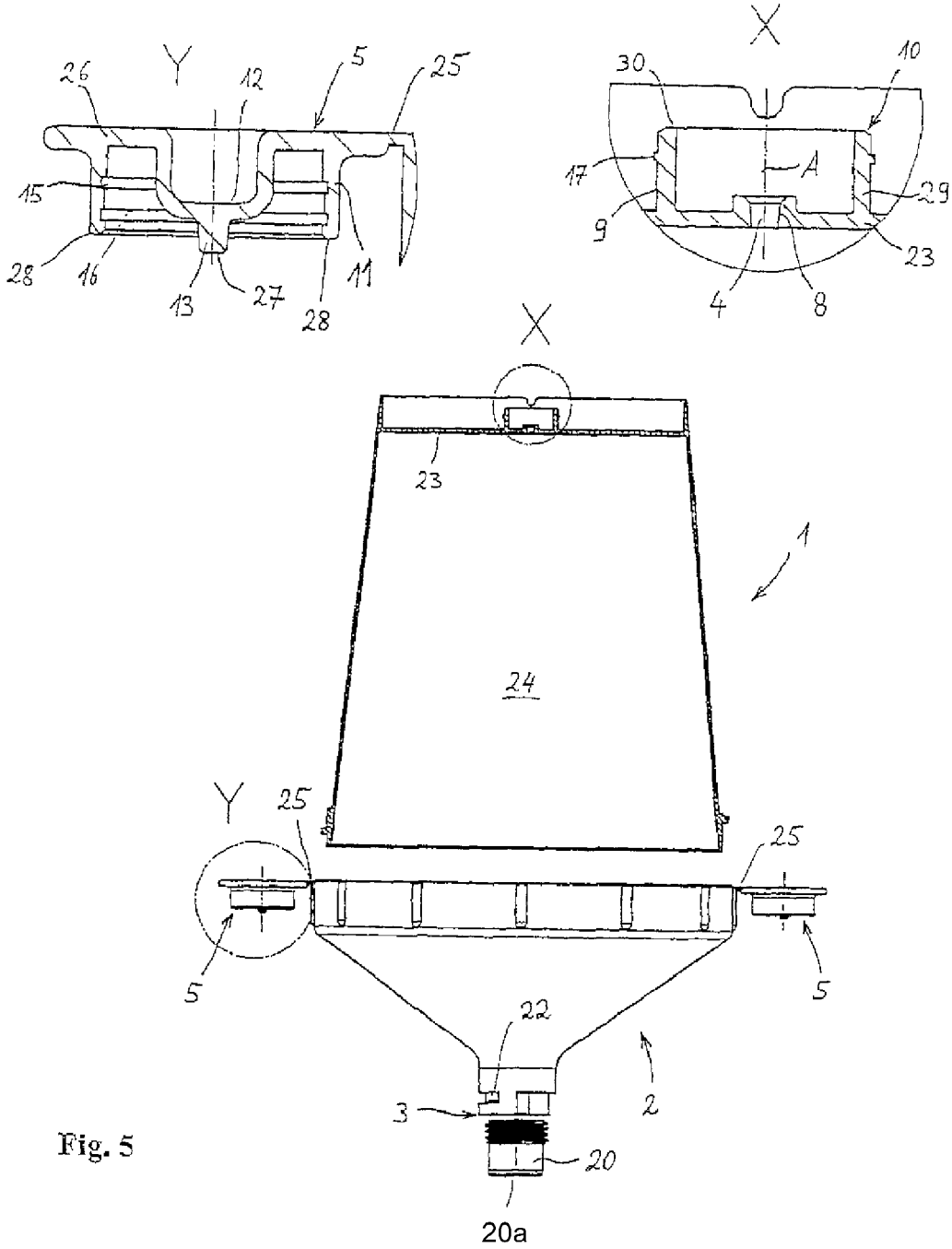
FIG. 5, side view of the fluid reservoir according to the invention, wherein the receptacle is represented in cross section and detail views of areas X and Y are shown.

The fluid reservoir is shown in a side view in FIG. 5, wherein receptacle 1 is shown in section. The central area of receptacle bottom 23 is shown in detail view X of FIG. 5. A hollow cylindrical projection 10, wall 29 of which projects vertically outward from receptacle bottom 23, is formed on receptacle bottom 23. Projection 10 is integral with receptacle bottom 23. Central axis A of hollow cylindrical projection 10 is arranged concentrically to the central axis of receptacle 1. A ventilation part 4 is formed in receptacle bottom 23, likewise concentrically to axis A. Ventilation part 4 is enclosed by an annular wall 8. A radially running annular rib 17 is formed on outer side 9 of wall 29. It is evident from the representation of FIG. 3 that a plurality of depressions 18, which are arranged segment by segment in the radial direction with a distance between one another, are provided in outer side 9. Depressions 18 extend axially from upper edge 30 of projection 10 to roughly half the height of projection 10 (FIG. 4). Openings can also be provided instead of depressions 18.

As is illustrated in FIG. 5, two closure elements are formed onto lid 2, each via pull off tabs 25. Pull off tabs 25 are formed as predetermined breakage points so that closure elements 5 are each identical to the other, and serve to close ventilation part 4 on the one hand and to close outlet opening 20*a* on the other.

As is evident from detail view Y in FIG. 5, closure element 5 has a hollow cylindrical base body 11 and a lid 26 formed integrally with it. In a central area, lid 26 is indented into the interior of base body 11, that is, downwards in the detail view Y of FIG. 1, in order to form a plug 12. A stopper 13 tapering conically downwards is formed on the underside of this plug 12. The underside 27 of stopper 3 projects past lower edge 28 of base body 11. Two annular grooves 15 and 16, running parallel and apart from one another, are formed on the outer side of hollow cylindrical base body 11.

One of the two closure elements 5 cooperates with projection 10 to form a valve for closure of ventilation part 4, with projection 10 projecting from receptacle bottom 23 forming the housing and closure element 5 forming the valve cover. The valve is constructed here as a double seat valve, with two valve seats arranged one after the other in the direction of flow and separated from one another. Each valve seat has its own sealing surface, 6 and 7, respectively. The cooperation of closure element 5 and projection 10 to form the valve with which ventilation part 4 can be closed off is shown in detail in FIG. 4. For this purpose, closure element 5 is pushed over projection 10, so that hollow cylindrical base body 11 embraces the cylindrical wall of projection 10. In order to guarantee a tight contact of closure element 5 on projection 10, the inside diameter of hollow cylindrical base body 11 and the outer diameter of hollow cylindrical projection 10 are roughly equally large.

The valve formed by closure element 5 and projection 10 can be fixed in two valve positions by cooperation of grooves 15 and 16 on the inner side of base body 11 and annular rib 17 on the outer side of projection 10. In the valve position shown in FIG. 4(*a*), annular rib 17 engages with upper annular groove 15 and lower edge 28 of hollow cylindrical base body 11 rests on receptacle bottom 23. At the same time, stopper 13 engages with ventilation part 4. The outer surface of stopper 13 rests tightly against wall 8 of ventilation part 4 in this case. In this manner, a first valve seat with a first sealing surface 6 is formed. At the same time, a second sealing surface 7 separated from first sealing surface 6 is formed by virtue of the fact that the inner side of base body 1I rests tightly against outer wall 9 of hollow cylindrical projection 10. In this valve position, ventilation part 4 is tightly closed by the first valve seat (which is formed by the engagement of stopper 13 with ventilation part 4) on the one hand and, on the other, by way of the second valve seat (which is formed by the contact of inner side 14 of base body 11 with the lower periphery of outer wall 9). If a small amount of paint were to flow out of ventilation part 4 through the first valve with first sealing surface 6, the further flow of paint out of receptacle 1 is prevented by the second valve seat.

To open ventilation part 4, closure element 5 can be brought into a second valve position, as illustrated in FIG. 4(*b*). For this purpose, the closure element is raised upwards, that is, away from receptacle bottom 23, until annular rib 17 engages with lower annular groove 16 (FIG. 4(*b*)). To facilitate this raising of closure element 5 from the first to the second valve position and to detach the initial seating of annular rib 19 in upper annular groove 15, it is advantageous for lid part 26 of closure element 5 to project laterally past base body 11. On the one hand, an easier gripping of the closure element on lid 26 is made possible thereby, and on the other, the engagement of annular rib 17 in upper annular groove 15 of lid 26 can be released, because the inside diameter in the area of base body 11 is enlarged by bending this projecting part of lid part 26 upwards.

In the second valve position shown in FIG. 4(*b*), stopper 13 is disengaged from ventilation part 4 so that the latter is opened up. At the same time, the second valve seat is also released, since lower edge 28 of base body 11 lies in the area of depressions 18 on the outer side of projection 10 in this valve position, as is evident from FIG. 4(*b*), right side. In this position, it is possible for air to pass from the interior of receptacle 1 through ventilation part 4 and through the passageway formed between depressions 18 and inner side 14 of base body 11.

Figure 6:
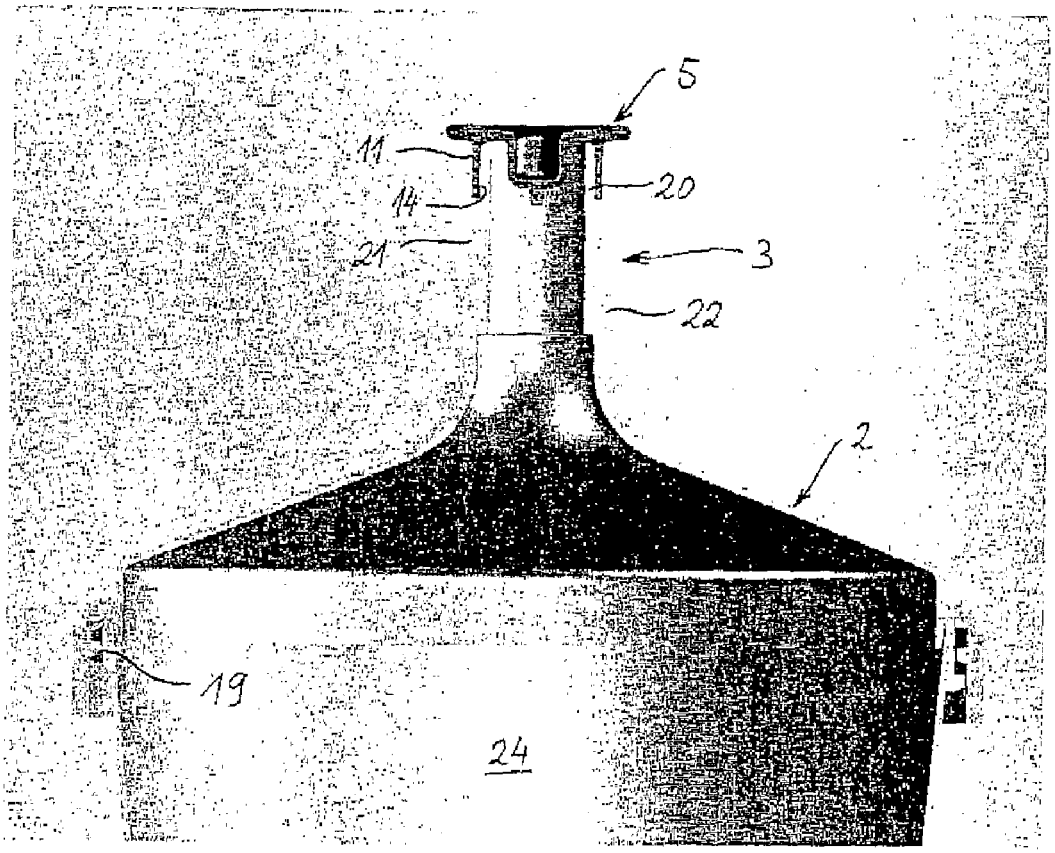
FIG. 6, sectional representation of the fluid reservoir of FIG. 1 in the area of the lid.

The second closure element 5 formed on lid 2, which is formed identically to the other closure element 6, can be used for closing off outlet opening 20*a* on the connecting element of lid 2 in that this closure element 5 is first broken off lid 2 and then placed on outlet neck 20. The inside diameter of base body 11 and the outside diameter of outlet neck 20 are matched to one another for this purpose, so that inner side 14 of base body 11 rests tightly against the outer side of neck 20, as shown in FIG. 6.

Figure 7:
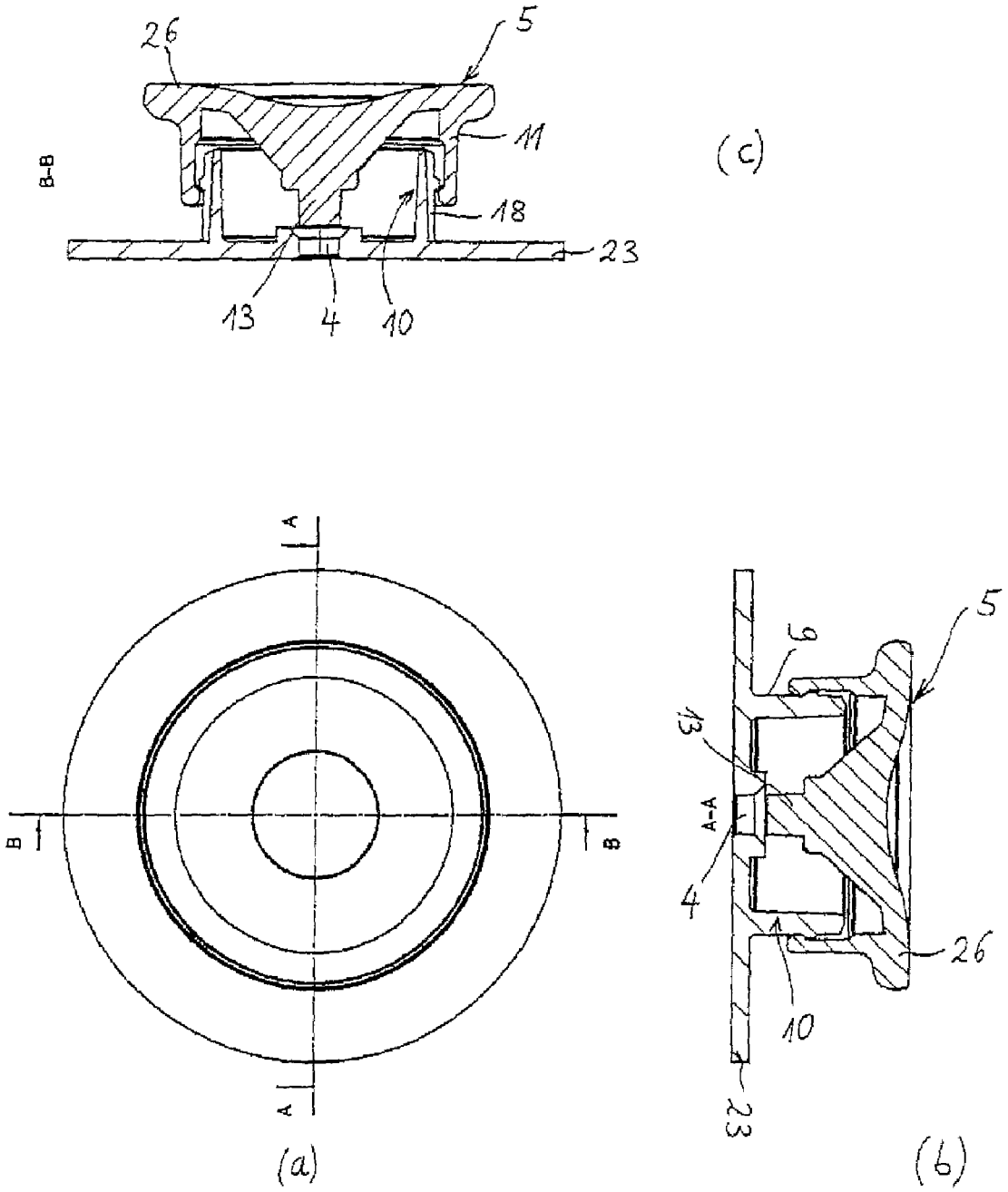
FIG. 7, top view onto an alternative embodiment of a valve for closing the ventilation part in the receptacle bottom (FIG. 7*a*) and sectional representations of this alternative embodiment along line A-A (FIG. 7*b*) and along line B-B (FIG. 7*c*), wherein the valve is shown in the opened position.

Another embodiment of a valve for closing off ventilation part is illustrated in FIG. 7. FIG. 7*a* shows a top view of this valve which, just like the above described valve, has two valve seats arranged one behind the other in the direction of flow. Identical components of this valve are furnished with the same reference numbers as in FIGS. 3 5. As in the embodiment shown in those figures, projection 10 also forms the valve housing in the valve shown in FIG. 7, and a closure element 5 forms the valve cover. The valve is likewise constructed as a double valve with two valve seats separated from one another, each valve seat having its own sealing surface 6 and 7, respectively. Closure element 5 is pushed over projection 10 such that it grips it, with hollow cylindrical base body 11 embracing the cylindrical wall of projection 10. In the center, closure element 5 has a cylindrical stopper 13, which engages with ventilation part 4 in the closed valve position and forms first sealing surface 6 there. Second sealing surface 7 is again formed on outer wall 9 of projection 10, where inner surface 14 of closure element base body 11 rests against it.

Figure 8:
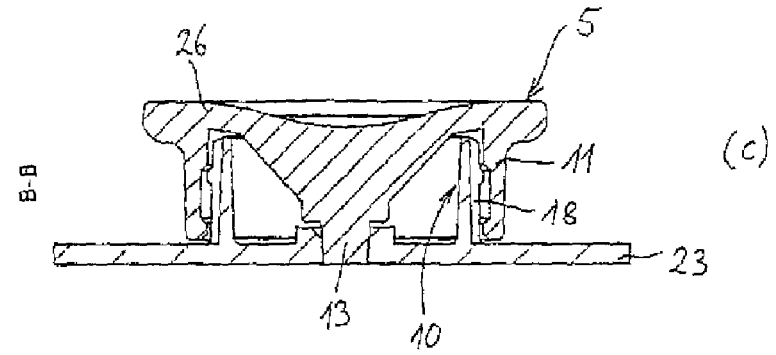
FIG. 8, representation of the alternative embodiment of the valve, shown as in FIG. 7, but in the closed position of the valve.
Figure 8:
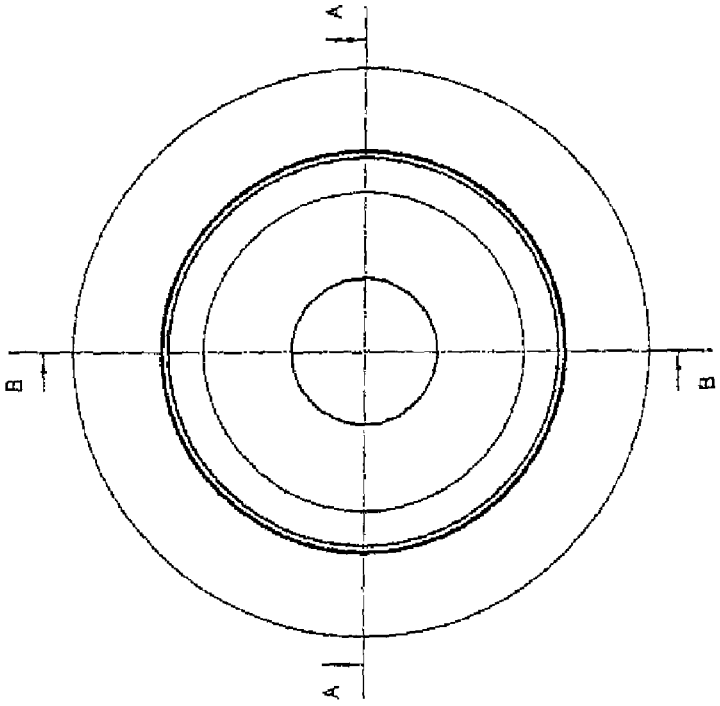
Figure 8:
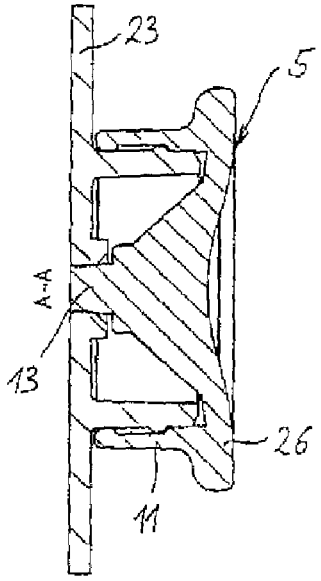

Unlike the embodiments of FIGS. 3-5, closure element 5 shown in FIG. 7 is not seated on projection 10 via an engagement mechanism, but rather grips it. Closure element 5 can be displaced between a first limit position and a second limit position, with the valve being opened in the first limit position, as shown in FIGS. 7*a* and 7*b*, and closed in the second limit position, as shown in FIGS. 8*a* and 8*b*. An annular rib 17*a* is formed on the outer side of projection 10. An annular groove 15*a* in closure element 5, which cooperates with annular rib 17*a* to form two stops in the first and second valve position, is provided on the inner surface of hollow cylindrical base body 11. In the valve position shown in FIG. 7, the lower edge of annular groove 15*a* rests against annular rib 17*a*, and in the closed valve position shown in FIG. 8, the upper edge of annular groove 15*a* rests against annular rib 17*a*. Between these two positions, closure element 5 is displaceable relative to projection 10.

In an embodiment of the fluid reservoir not represented graphically here, it is provided that ventilation part 4 is first closed off by a thin membrane, and is then punctured into the first valve position only upon insertion of closure element 5 by pushing a sharp point formed on stopper 13 of closure element 5 through the thin membrane.

Due to the formation of two separate valve seats, each with a sealing surface 6 or 7, respectively, a tight closure of ventilation part 4 becomes possible with the fluid reservoir according to the invention. This closure is distinguished from measures for closing off the ventilation part in the container's bottom that were known from prior art by better leak tightness. Ultimately this makes it possible to set the container on the floor without paint present in the container leaking out. It is thereby made possible, in particular, to mix paint in the container before the container is then placed in the usual manner on the paint spray gun. The valve for closing off the ventilation part is further distinguished by the fact that closure element 5 can easily be removed manually from the container by pulling it off after undoing the snap connection. This makes it possible for excess paint that was not consumed in the painting process to flow out of ventilation part and be recycled if the container is held with the receptacle bottom facing downwards.

In an alternative embodiment, not shown graphically here, ventilation part 4 and projection 10 surrounding it is situated eccentrically relative to the longitudinal central axis of receptacle 1, i.e., ventilation part 4 as well as central axis A of projection 10 are eccentric relative to receptacle bottom 23.

Furthermore, the valve for closing off ventilation part 4 can be constructed such that it can be set to more than two valve positions. For this purpose it is provided, for instance, that more than two annular grooves 15, 16 are arranged on the outer side of hollow cylindrical base body 11. As an alternative to a plurality of annular grooves for forming a valve that can be locked in several positions, it is also possible for double annular grooves to be formed in parallel and with a distance between one another.

The invention claimed is:

1. In a fluid reservoir for a paint spray gun comprised of a receptacle and a lid that can be placed thereon, wherein the lid has provision for placing the fluid reservoir on the paint spray gun or an adapter and wherein the receptacle has a ventilation port that can be opened and closed by means of a valve, the improvement comprising: a double seat valve with two valve seats one after the other in the direction of flow and separated from one another; said double seat valve being comprised of (a) the ventilation port formed as a tapered through hole in a wall of the receptacle to define a first valve seat;

(b) an open hollow cylinder surrounding said tapered through hole, said open hollow cylinder having a preselected external diameter, oriented normal to the receptacle wall, and having an exterior surface extending from the receptacle wall to its open end, said exterior surface of said hollow cylinder defining a second valve seat adjacent said receptacle wall;

(c) a closure element received on said open hollow cylinder and being in engagement with the exterior surface, said closure element being composed of a hollow cylindrical base body having an internal diameter substantially equal to said preselected external diameter of said open hollow cylinder, and a cap formed on one end of said base body;

(d) said cap including a support part that extends from said cap and terminates at its lower end in a tapered plug for cooperating with said tapered hole to form a first tight seal;

(e) a portion of said hollow cylindrical base body contacting said second valve seat defined by said exterior surface of said hollow cylinder adjacent said receptacle wall to form a second tight seal (f) said closure element being displaceable relative to said open hollow cylinder between a first position, in which the ventilation port is closed off by the double seat valve and any leakage of liquid from the receptacle through the first tight seal will be trapped by the second tight seal, and a second position, in which the double seat valve is open and an equalization of pressure is achieved via ventilation flow.

2. The improvement according to claim 1 wherein said closure element is releasably held relative to said hollow cylinder in the first and second positions by mutually coacting elements.

3. The improvement according to claim 2 wherein the mutually coacting elements comprise a rib projecting radially from one of said open hollow cylinder and hollow cylindrical base body and two spaced circumferentially extending grooves defined by the other of said open hollow cylinder and hollow cylindrical base body.

4. The improvement according to claim 2 wherein a bypass channel for air is defined by said open hollow cylinder located between the second tight seal and the open end of the open hollow cylinder.

5. In a fluid reservoir for a paint spray gun comprised of a receptacle and a lid that can be placed thereon, wherein the lid has provision for placing the fluid reservoir on the paint spray gun or an adapter and wherein the receptacle has a ventilation port that can be opened and closed by means of a valve, the improvement comprising: a double seat valve with two valve seats one after the other in the direction of flow and separated from one another; said double seat valve being comprised of (i) the ventilation port formed as a tapered through hole in a wall of the receptacle to define a first valve seat;

(ii) an open hollow cylinder surrounding said tapered through hole, said open hollow cylinder having a preselected external diameter, oriented normal to the receptacle wall, and having an exterior surface extending from the receptacle wall to its open end, said exterior surface of said hollow cylinder defining a second valve seat adjacent said receptacle wall;

(iii) a valve closure element composed of a cap from which depends an open hollow cylindrical base member having an internal diameter substantially equal to said preselected external diameter and having an interior surface;

(iv) said valve closure element being received on said hollow cylinder with the interior surface of the valve closure element engaging the exterior surface of the hollow cylinder and with the cap having clearance from the open end of the hollow cylinder;

(v) said valve closure element defining a support part that extends from said cap to below the open end of the hollow cylindrical base member and terminates at its lower end in a tapered plug to be received in said tapered hole and in cooperation therewith to serve as a first tight seal;

(vi) said valve closure element defining a portion of the interior surface located at the open end of the open hollow cylindrical base member that coacts with said second valve seat to serve as a second tight seal;

(vii) said first and second tight seals being arranged serially in the direction of a ventilation flow pathway that extends from said ventilation through hole, through the clearance between the hollow cylinder and the support member, through the clearance between the cap and the open end of the hollow cylinder, between the exterior surface of the hollow cylinder and the interior surface of the hollow cylindrical base member, and exiting through the open end of the hollow cylindrical base member;

(viii) said valve closure element being displaceable relative to said hollow cylinder between a first position, in which the ventilation port is closed off serially by said first and second tight seals so the interior of the receptacle is shut off from the environment and any leakage of the first tight seal will be trapped by the second tight seal, and a second position, in which the double seat valve is open and an equalization of pressure is achieved via the ventilation flow pathway.

6. In a fluid reservoir for a paint spray gun comprised of a receptacle and a lid that can be placed thereon, wherein the lid has a connecting element in order to place the fluid reservoir on the paint spray gun or an adapter and wherein the receptacle has a ventilation port that can be opened and closed by means of a valve, the improvement comprising: a double seat valve with two valve seats one after the other in the direction of flow and separated from one another; said double seat valve being comprised of a. the ventilation port formed as a tapered through hole in a wall of the receptacle to define a first valve seat, b. a hollow cylinder surrounding said tapered through hole, said hollow cylinder having a preselected external diameter, is oriented normal to the receptacle wall, and having an exterior surface extending from the receptacle wall to the open end, c. a peripheral rib projecting radially from said exterior surface located between the receptacle wall and said open end, d. said exterior surface defining a second valve seat adjacent said receptacle wall, e. a passageway defined in the exterior surface from a point above said second valve seat to said open end;

f. a valve closure element composed of a cap from which depends a hollow cylindrical base member having an internal diameter substantially equal to said preselected external diameter and having an interior surface in which is defined two spaced circumferentially extending grooves, g. said valve closure element defining a part that depends from said cap to below the hollow cylindrical base member and has a cross section to easily fit into said hollow cylinder with clearance and terminates at its lower end in a tapered plug to be received in said tapered hole and in cooperation therewith to serve as a first tight seal;

h. said valve closure element defining a surface located at a lower part of the hollow cylindrical base member that coacts with said second valve seat to serve as a second tight seal;

i. said first and second tight seals being arranged one behind the other relative to ventilation flow;

j. said valve closure element being displaceable relative to said hollow cylinder between a first position, in which ventilation is closed off by said first and second tight seals, and a second position, in which both said first and second tight seals are open and an equalization of pressure between the interior of the receptacle and the environment is made possible via the ventilation port, and k. said valve closure element being held detachably relative to said hollow cylinder in the second position by the coaction of said rib and said grooves.

7. A kit for a paint spray gun comprised of a receptacle and a lid that can be placed thereon, wherein the lid has a connecting element in order to place the fluid reservoir on the paint spray gun or an adapter and wherein the receptacle has a ventilation port that can be opened and closed by means of a double seat valve with two valve seats one after the other in the direction of flow and separated from one another said double seat valve being comprised of the ventilation port formed as a tapered through hole in a wall of the receptacle to define a first valve seat; said tapered through hole surrounded by an open hollow cylinder, having a preselected external diameter, oriented normal to the receptacle wall, and having an exterior surface extending from the receptacle wall to its open end, said exterior surface of said hollow cylinder defining a second valve seat adjacent said receptacle wall;

a valve closure element detachably connected to the lid and being composed of a cap from which depends an open hollow cylindrical base body having an internal diameter substantially equal to said preselected external diameter, said open hollow cylindrical base body being receivable over the open end of said hollow cylinder and engageable with the exterior surface;

a support part that extends with clearance from said cap to below the hollow cylindrical base body and terminates at its lower end in a tapered plug for cooperating with said tapered hole to effect a first tight seal;

a portion of the hollow cylindrical base body remote from said cap that cooperates with said second valve seat to effect a second tight seal;

said first and second tight seals being arranged serially relative to ventilation the path of which extends from said through hole, between the hollow cylinder and the support member, between the cap and the open end of the hollow cylinder, and between the exterior surface of the hollow cylinder and the hollow cylindrical base body exiting to the environment;

said valve closure element being displaceable relative to said hollow cylinder between a first position, in which the ventilation port is closed off serially by said first and second tight seals so interior of the receptacle is shut off from the environment and any leakage of liquid from the receptacle through the first tight seal into the ventilation path will be trapped by the second tight seal, and a second position, in which both tight seals are open and an equalization of pressure is achieved via ventilation flow; and said valve closure element being releasably held relative to said hollow cylinder in one of the first and second valve positions.

8. The kit according to claim 7 wherein at least one valve closure element is integrally attached to an edge of the lid by a web, the web being a predetermined breaking point so the valve closure element can be torn off.

* * * * *